US008286836B2

(12) United States Patent
Yates

(10) Patent No.: US 8,286,836 B2
(45) Date of Patent: Oct. 16, 2012

(54) DISPENSING TUBE ASSEMBLY AND FOAM GENERATOR FOR COAXIAL TUBES

(75) Inventor: James M. Yates, Akron, OH (US)

(73) Assignee: GOJO Industries, Inc., Akron, OH (US)

( * ) Notice: Subject to any disclaimer, the term of this patent is extended or adjusted under 35 U.S.C. 154(b) by 357 days.

(21) Appl. No.: 12/287,877

(22) Filed: Oct. 14, 2008

(65) Prior Publication Data

US 2010/0089951 A1 Apr. 15, 2010

(51) Int. Cl.
*B67D 7/76* (2010.01)

(52) U.S. Cl. ..... 222/190; 222/145.5

(58) Field of Classification Search ..... 222/145.5, 222/189.11, 190; 239/432
See application file for complete search history.

(56) References Cited

U.S. PATENT DOCUMENTS

| | | | | |
|---|---|---|---|---|
| 708,893 | A | 9/1902 | Lundholm | |
| 982,584 | A | 1/1911 | Frink | |
| 3,361,304 | A * | 1/1968 | Thompson | 222/190 |
| 3,531,050 | A | 9/1970 | Abraham et al. | |
| 3,888,420 | A | 6/1975 | Boelkins | |
| 4,615,467 | A | 10/1986 | Grogan et al. | |
| 4,669,665 | A | 6/1987 | Shay | |
| 4,767,060 | A | 8/1988 | Shay et al. | |
| 5,234,167 | A | 8/1993 | Martin | |
| 5,462,208 | A | 10/1995 | Stahley et al. | |
| 5,544,788 | A * | 8/1996 | Meyer | 222/110 |
| 5,553,785 | A * | 9/1996 | Haruch | 239/432 |
| 5,647,539 | A | 7/1997 | Dobbs et al. | |
| 5,732,885 | A * | 3/1998 | Huffman | 239/416.5 |
| 5,984,146 | A | 11/1999 | Kaufmann | |
| 6,042,089 | A | 3/2000 | Klein | |
| 6,082,586 | A * | 7/2000 | Banks | 222/95 |
| 6,267,301 | B1 * | 7/2001 | Haruch | 239/290 |
| 6,968,776 | B2 | 11/2005 | Paoletti | |

(Continued)

FOREIGN PATENT DOCUMENTS

EP 1974640 A2 10/2008

(Continued)

OTHER PUBLICATIONS

International Preliminary Report on Patentability from International Application No. PCT/US2009/060459 dated Apr. 19, 2011.

*Primary Examiner* — Kevin P Shaver
*Assistant Examiner* — Daniel R Shearer
(74) *Attorney, Agent, or Firm* — Calfee, Halter & Griswold LLP

(57) ABSTRACT

A dispensing tube assembly includes a first component delivery tube surrounded by a second component delivery tube. The first component delivery tube provides an axial passage, and an annular passage is defined between the first component delivery tube and the second component delivery tube. A component travelling through the axial passage is diverted to enter the surrounding annular passage and mix with a second component traveling in that annular passage. The premixture formed by this mixture of components is then diverted from the annular passage into a post mix chamber and ultimately dispensed as a foam. A foam media may be employed to homogenous the premixture and create a high quality foam. The dispensing tube assembly is advantageously employed in a dispenser wherein soap and air are advanced through coaxial tubes to be mixed and create a foamed soap product.

19 Claims, 3 Drawing Sheets

U.S. PATENT DOCUMENTS

| | | | | |
|---|---|---|---|---|
| 7,066,355 | B2 * | 6/2006 | Lewis et al. | 222/145.5 |
| 7,364,053 | B2 | 4/2008 | Ophardt | |
| 7,455,197 | B2 | 11/2008 | Ophardt | |
| 2001/0032892 | A1 | 10/2001 | Brooks | |
| 2004/0069807 | A1 | 4/2004 | Brouwer et al. | |
| 2005/0258192 | A1 * | 11/2005 | Matthews et al. | 222/190 |
| 2006/0011655 | A1 | 1/2006 | Ophardt | |
| 2008/0237266 | A1 * | 10/2008 | Ciavarella et al. | 222/190 |

FOREIGN PATENT DOCUMENTS

| | | | |
|---|---|---|---|
| WO | 9949769 | A1 | 10/1999 |
| WO | 03095097 | A1 | 11/2003 |
| WO | 2008072949 | A2 | 6/2008 |

* cited by examiner

DISPENSING TUBE ASSEMBLY AND FOAM GENERATOR FOR COAXIAL TUBES

FIELD OF THE INVENTION

This invention generally relates to a dispensing tube assembly that serves to mix first and second components advancing through coaxial tubes. More particularly, this invention relates to a foam generator that fits over the ends of coaxial tubes and defines flow paths causing the first and second components to mix before being dispensed at a common outlet.

BACKGROUND OF THE INVENTION

The use of soap dispensers continues to grow as the awareness for the need for good hand hygiene practices grows. Numerous types of dispensing systems are known, including portable, handheld dispensers, wall mounted dispensers, and counter-mounted dispensers. Typically, these soap dispensers dispense a predetermined amount of liquid soap upon actuation. Over the past decade or so, interest has grown in foam soap dispensers, wherein air and liquid soap are mixed to form and dispense substantially homogenous foam.

Of particular interest here are those foam soap dispensers that employ coaxial tubes, with one tube carrying the soap product, and the other tube carrying the air or other component necessary to cause the soap to foam before being dispensed. Using a coaxial tube structure, it is possible to advance the individual components to a foam generator placed near the ultimate outlet of the dispenser. Thus, the soap and air remain separate until mixing directly before dispensing and, in this way, the force needed to dispense the foam product can be reduced, inasmuch as advancing the individual components through coaxial tubes is easier than advancing a foam product through a long length of tubing. Thus, there exists a need in the art for a dispensing tube assembly employing coaxial tubes and a foam generator that serves to cause individual components advancing through those coaxial tubes to mix and create a quality foam product.

SUMMARY OF THE INVENTION

In one embodiment, this invention provides a dispensing tube assembly including a first component delivery tube providing an axial passage defining an axial flow path, and a second component delivery tube surrounding the first component delivery tube to create an annular passage defining an annular flow path. An axial path end plate blocks the axial flow path, and a plurality of premix apertures extend from the axial flow path to the annular flow path, proximate the axial path end plate. The dispensing tube assembly further includes a post mix chamber, and a plurality of post mix apertures extend from the annular flow path to the post mix chamber. Along the flow direction, the plurality of post mix apertures are positioned downstream of the plurality of premix apertures. A plurality of annular premix chambers are defined in the annular flow path between the plurality of premix apertures and the plurality of post mix apertures, and an annular flow path end plate blocks the annular flow path proximate the plurality of post mix apertures. With this structure, a first component advanced along the axial flow path toward the post mix chamber exits the axial flow path at the plurality of premix apertures and enters the annular premix chamber due to the blocking of the axial flow path by the axial path end plate. A second component advanced along the annular flow path toward the post mix chamber mixes with the first component entering the annular premix chamber to form a premixture that exits the annular flow path at the plurality of post mix apertures and enters the post mix chamber due to the blocking of the axial flow path by the annular flow path end plate.

Thus, with the dispensing tube assembly generally outlined above, a component traveling through an inner axial passage is diverted to enter a surrounding annular passage and mix with a second component traveling in that annular passage. The premixture formed when the first and second components mix is then diverted from the annular passage into a post mix chamber. In particular embodiments, the post mix chamber can include a foam media through which the premixture of the first and second components passes, making the mixture more homogenous. In the case of a soap first component and an air second component, a foam soap product is created.

DETAILED DESCRIPTION OF ILLUSTRATIVE EMBODIMENTS

Figure 1:
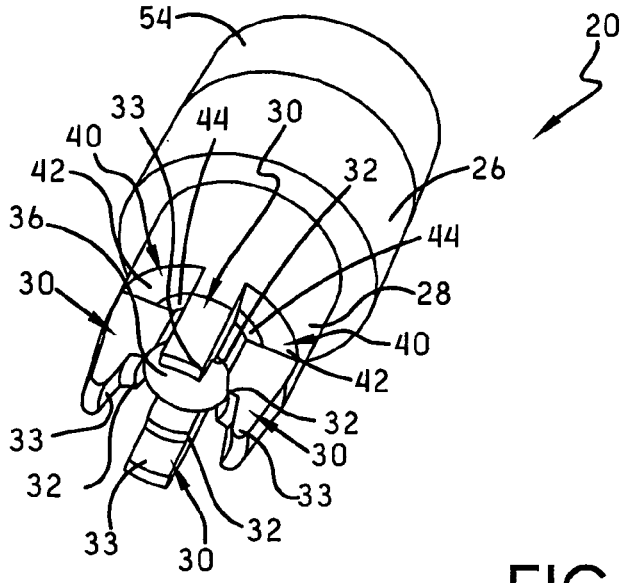
FIG. 1 is a perspective view of a foam generator of a dispensing tube assembly in accordance with this invention.
Figure 3:
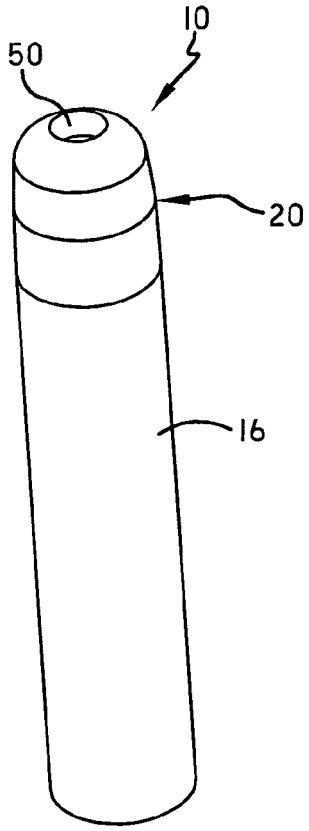
FIG. 3 is a perspective view of the foam generator of FIG. 1, shown mounted to a second tube, the second tube surrounding the first tube of FIG. 2 to create coaxial tubes.
Figure 2:
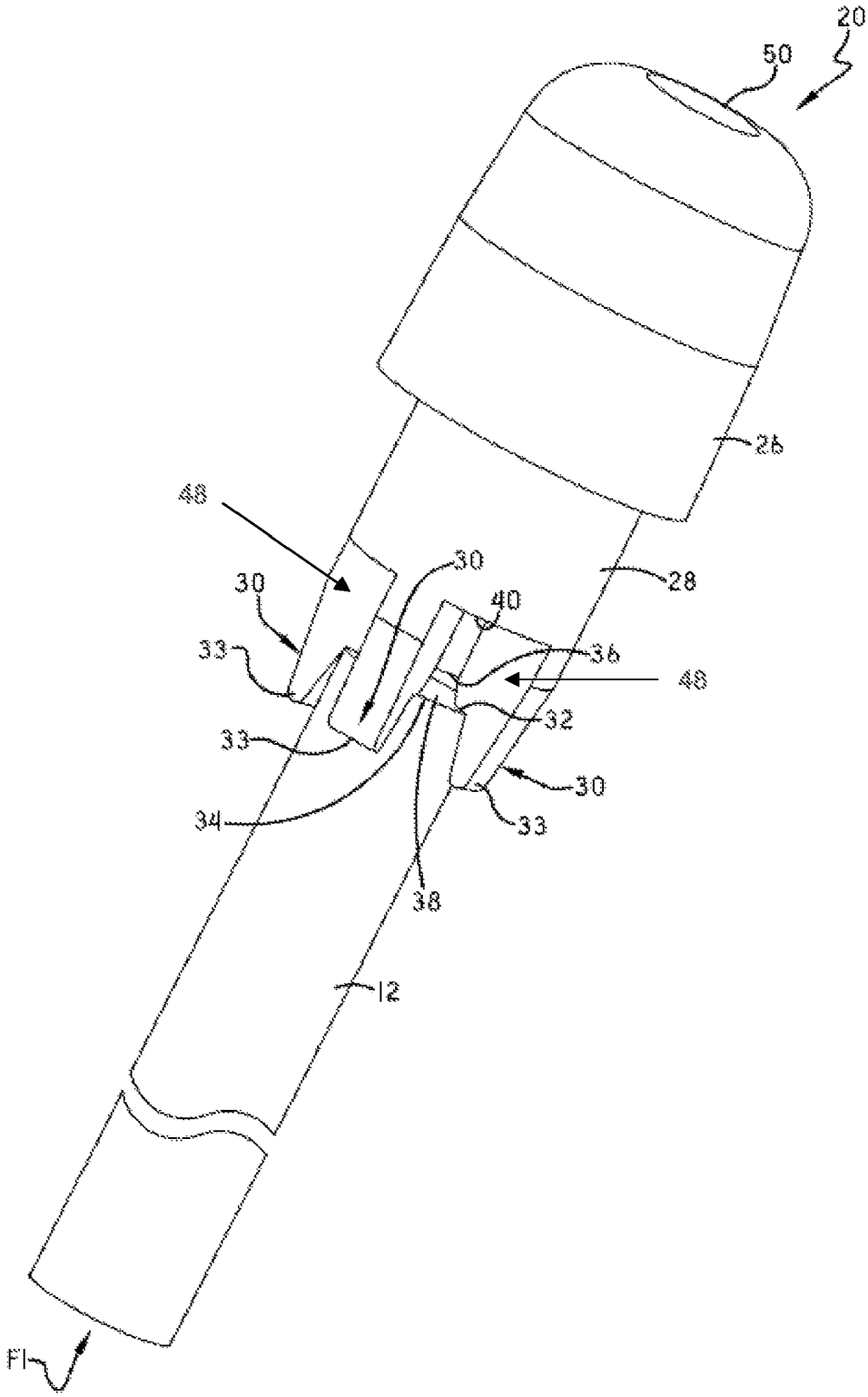
FIG. 2 is a perspective view of the foam generator of FIG. 1, shown mounted to a first tube.
Figure 4:
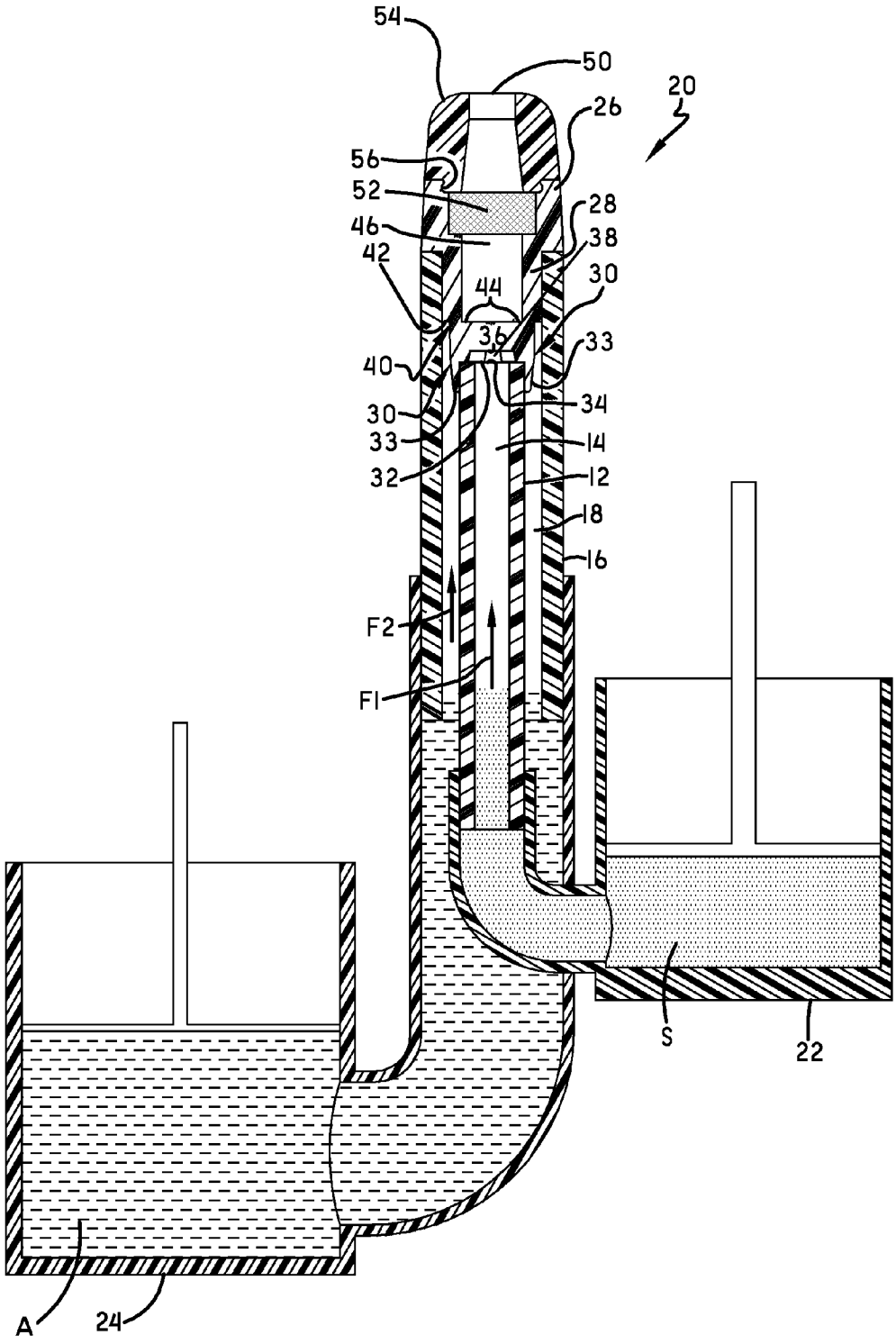
FIG. 4 is a cross sectional view of a dispensing tube assembly in accordance with this invention, showing the foam generator as fitted to the coaxial tubes.

With reference to FIGS. 1-4, a dispensing tube assembly in accordance with this invention is shown and designated by the numeral 10. The complete dispensing tube assembly is seen in FIG. 3, while various components are appreciated from the other figures. The dispensing tube assembly 10 includes a first component delivery tube 12 (FIG. 2) providing an axial passage 14 defining an axial flow path F1. The dispensing tube assembly 10 also includes a second component delivery tube 16 (FIG. 3), which surrounds the first component delivery tube 12 to define an annular passage 18, defining an annular flow path F2. A foam generator 20 is fitted to the coaxial first and second component delivery tubes 12, 16 to complete the dispensing tube assembly 10. As is appreciated in FIG. 1, the foam generator 20 can be a separate element structured to fit onto coaxial tubes. However, it should be appreciated that a dispensing tube assembly in accordance with this invention might also be provided through the use of less or more individual components.

A first component S is advanced through the first component delivery tube 12 by an appropriate flow generator (e.g., a pump) from a first component source 22, and a second component A is similarly advanced through the second component delivery tube 16 from a second component source 24. In a particular embodiment of this invention, the first component S is soap, and the second component A is air, and each of these components is advanced through its respective delivery tube 12, 16 by any type of foam pump mechanism currently known or developed hereafter. The ultimate source for the air in such an embodiment is typically the atmosphere, while the soap is provided from a suitable container. A particular foam pump mechanism employing coaxial tubes to generate foam soap is disclosed in copending U.S. patent application Ser. No.

11/728,557, and this foam generator 20 could be readily employed to cap the coaxial tubes and generate the foam soap.

The foam generator 20 includes a body portion 26 having an axial extension 28 that is sized to fit intimately within the inside diameter of the second component delivery tube 16. Four mounting arms 30 extend axially from axial extension 28 to fit over the first component delivery tube 12. More particularly, each arm 30 has an associated radial step 32 that rests on the end surface 34 of the first component delivery tube 12, and an arm extension 33 that extends down the outer diameter of the first component delivery tube 12. In this embodiment, the mounting arms 30 are each radially offset from neighboring mounting arms 30 by 90 degrees.

The radial steps 32 distance the end surface 34 from an axial path end plate 36 which defines an axial terminus for the axial flow path F1. The first component S is therefore prevented from further travel along the axial flow path F1 as it comes into contact with the axial path end plate 36. Instead, the first component S must travel radially into the annular passage 18, to flow along the annular flow path F2 through the four premix apertures 38 (FIGS. 2 and 4) that are formed between the end surface 34, the end plate 36, and neighboring steps 32.

Similarly, the axial extension 28 of the body portion 26 provides an annular flow path end plate 40, which is a bottom radial surface 42 of the axial extension 28, segmented by the mounting arms 30. The annular flow path end plate 40 defines an axial terminus for the annular passage 18, and four post mix apertures 44 are formed between neighboring arms 30 and extend from the annular passage 18 to a post mix chamber 46 provided as a bore in the axial extension 28. The annular flow path end plate 40 defines an axial terminus for the annular passage 18, such that components flowing along the annular flow path F2 are forced through the post mix apertures 44 and into the post mix chamber 46.

With the structure described above, a first component S flowing through the axial passage 14 along the axial flow path F1 is forced into the second component A flowing through the annular passage 18 along the annular flow path F2 when the first component S reaches the axial end plate 36 and travels through the premix apertures 38. Thus, four annular premix chambers 48 are defined in the annular passage 18 between the premix apertures 38 the post mix apertures 44 and the associated neighboring arms 30. These areas are termed "annular premix chambers" because it is at these locations where the first component S and the second component A first begin to mix. They are termed "chambers" because, even though they do not have particular boundaries in some directions, the chamber volume can be appreciated from an understanding of the structure already disclosed and the flow pattern of the components.

The premixture formed at the annular premix chambers 48 is forced into the post mix chamber 46 through the post mix apertures 44, and this premixture is advanced toward the outlet 50 of the foam generator 20. A foam media 52 is positioned in the foam generator 20, between the post mix chamber 46 and the outlet 50 such that the premixture must pass through the foam media 52 before being dispensed at the outlet 50. This foam media 52 serves to homogenize the mixture of the first component S and second component A, and may be provided in the form of a mesh screen or sponge-like or open-celled foam. In the embodiment shown, the foam media 52 is sandwiched between an end cap 54 and the body portion 26, with the end cap 54 connecting to the body portion 26 at a snap fit connection 56.

When employing the foam generator of the present invention to mix two fluids, it is preferred that the heavier of the two fluids be chosen to travel the path described above for the first component S, and that the lighter fluid be chosen to travel the path described for the second component A. The heavier fluid is thus split and injected into the stream of the lighter fluid via the premix apertures 28. The heavier fluid is also injected into the lighter fluid along a flow path that extends across the flow path of the lighter fluid, i.e., while the lighter fluid or, more broadly, the second component A is flowing axially, the heavier fluid or, more broadly, the first component S is caused to mix into that axial flow by being forced radially into that flow path. The difference in flow direction promotes mixing. The extrusion of the two components through the post mix apertures 44 also creates turbulent mixing, because the components are subjected to increased pressure as they travel through the restricted cross section passageways of the post mix apertures 44, and thereafter expand into the larger volume of the post mix chamber.

From the foregoing, it should be appreciated that the present invention provides a dispensing tube assembly that substantially improves the art, particularly with respect to the mixing of soap and air to create a foam soap product. Although a particular embodiment has been described in detail herein, the present invention is not limited thereto or thereby. Rather, the claims will serve to define the scope of the invention.

What is claimed is:

1. A dispensing tube assembly comprising:

a post mix chamber;

a first component delivery tube having a proximal end near a pumping portion of a first component delivery pump, the pumping portion including components that form a chamber that is reduced in volume, and a distal end located away from the pumping portion of the first component delivery pump, the first component delivery tube providing an axial passage defining an axial flow path to advance a first component in a flow direction toward said post mix chamber from a first component source;

a second component delivery tube having a proximal end near a pumping portion of a second component delivery pump, and a distal end located away from the pumping portion of the second component delivery pump, the second component delivery tube surrounding said first component delivery tube to create an annular passage defining an annular flow path to advance a second component in said flow direction toward said post mix chamber from a second component source;

a rigid axial path end plate blocking said axial flow path;

a premix aperture extending from said axial flow path to said annular flow path, proximate said axial path end plate;

a post mix aperture extending from said annular flow path to said post mix chamber, wherein, along said flow direction, said post mix aperture is positioned downstream of said premix aperture;

an annular premix chamber defined in said annular flow path between said premix aperture and said post mix aperture; and an annular flow path end plate blocking said annular flow path proximate said post mix aperture, wherein a first component advanced along said axial flow path toward said post mix chamber exits said axial flow path at said premix aperture and enters said annular premix chamber due to the blocking of the axial flow path by said axial path end plate, and a second component advanced along said annular flow path toward said post mix chamber mixes with said first component entering said annular premix chamber to form a premixture that exits said annular flow path at said post mix aperture and enters said post mix chamber due to the blocking of the axial flow path by said annular flow path end plate; and a mix media located downstream of the post mix aperture and proximate the post mix chamber.

2. The dispensing tube assembly of claim 1, wherein said first component is a foamable liquid, and said second component is air.

3. The dispensing tube assembly of claim 2, wherein said first component is soap.

4. The dispensing tube assembly of claim 1, comprising a plurality of said premix apertures and a plurality of said post mix apertures.

5. The dispensing tube assembly of claim 4, wherein said axial path end plate, said annular flow path end plate, said post mix chamber and said plurality of post mix apertures are provided by a foam generator unit that mates with said first component delivery tube and said second component delivery tube.

6. The dispensing tube of claim 5, wherein said foam generator unit includes an outlet and a foam media positioned between said post mix chamber and said outlet.

7. The dispensing tube assembly of claim 6, wherein said foam generator unit includes a body portion having an axial extension, said axial extension sized to fit intimately within the inside diameter of said second component delivery tube.

8. The dispensing tube assembly of claim 7, wherein a plurality of mounting arms extend from said axial extension to fit over said first component delivery tube.

9. The dispensing tube assembly of claim 1 wherein the axial path end plate and the annular flow path end plate are substantially parallel.

10. The dispensing tube assembly of claim 1 wherein said axial path end plate, said annular flow path end plate, said post mix chamber, said post mix apertures, and said mix media are provided in a foam generator that is removable from the first and second component delivery tubes.

11. A dispensing tube assembly comprising:

a post mix chamber;

a first component delivery tube providing an axial passage defining an axial flow path to advance a first component in a flow direction toward said post mix chamber from a first component source;

a second component delivery tube surrounding said first component delivery tube to create an annular passage defining an annular flow path to advance a second component in said flow direction toward said post mix chamber from a second component source;

an axial path end plate blocking said axial flow path;

a premix aperture extending from said axial flow path to said annular flow path, proximate said axial path end plate;

a post mix aperture extending from said annular flow path to said post mix chamber, wherein, along said flow direction, said post mix aperture is positioned upstream of said premix aperture;

an annular premix chamber defined in said annular flow path between said premix aperture and said post mix aperture; and an annular flow path end plate blocking said annular flow path proximate said post mix aperture, wherein a first component advanced along said axial flow path toward said post mix chamber exits said axial flow path at said premix aperture and enters said annular premix chamber due to the blocking of the axial flow path by said axial path end plate, and a second component advanced along said annular flow path toward said post mix chamber mixes with said first component entering said annular premix chamber to form a premixture that exits said annular flow path at said post mix aperture and enters said post mix chamber due to the blocking of the axial flow path by said annular flow path end plate; and further comprising a plurality of said premix apertures and a plurality of said post mix apertures;

wherein said axial path end plate, said annular flow path end plate, said post mix chamber and said plurality of post mix apertures are provided by a foam generator unit that mates with said first component delivery tube and said second component delivery tube;

wherein said foam generator unit includes an outlet and a foam media positioned between said post mix chamber and said outlet;

wherein said foam generator unit includes a body portion having an axial extension, said axial extension sized to fit intimately within the inside diameter of said second component delivery tube;

wherein a plurality of mounting arms extend from said axial extension to fit over said first component delivery tube; and wherein said first component delivery tube includes an end surface, and said plurality of mounting arms each include an associated radial step, and said plurality of premix apertures are formed between said end surface, said end plate, and neighboring radial steps of said mounting arms.

12. The dispensing tube assembly of claim 11, wherein there are four of said plurality of mounting arms, each mounting arm being radially offset from neighboring mounting arms by 90°.

13. A dispensing tube assembly comprising:

a post mix chamber;

a first component delivery tube providing an axial passage defining an axial flow path to advance a first component in a flow direction toward said post mix chamber from a first component source;

a second component delivery tube surrounding said first component delivery tube to create an annular passage defining an annular flow path to advance a second component in said flow direction toward said post mix chamber from a second component source;

an axial path end plate blocking said axial flow path;

a premix aperture extending from said axial flow path to said annular flow path, proximate said axial path end plate;

a post mix aperture extending from said annular flow path to said post mix chamber, wherein, along said flow direction, said post mix aperture is positioned downstream of said premix aperture;

an annular premix chamber defined in said annular flow path between said premix aperture and said post mix aperture; and an annular flow path end plate blocking said annular flow path proximate said post mix aperture, wherein a first component advanced along said axial flow path toward said post mix chamber exits said axial flow path at said premix aperture and enters said annular premix chamber due to the blocking of the axial flow path by said axial path end plate, and a second component advanced along said annular flow path toward said post mix chamber mixes with said first component entering said annular premix chamber to form a premixture that exits said annular flow path at said post mix aperture and enters said post mix chamber due to the blocking of the axial flow path by said annular flow path end plate; and a mix media located downstream of the post mix aperture and proximate the post mix chamber;

wherein said axial path end plate, said annular flow path end plate, said post mix chamber, said post mix apertures, and said mix media are provided in a foam generator having a plurality of arms configured to connect to an end surface of the first component delivery tube.

14. The dispensing tube assembly of claim 13 wherein the foam generator includes an axial extension configured to connect to an end of the second component delivery tube.

15. A dispensing tube assembly comprising:

a post mix chamber;

a first component delivery tube providing an axial passage defining an axial flow path to advance a first component in a flow direction toward said post mix chamber from a first component source;

a second component delivery tube surrounding said first component delivery tube to create an annular passage defining an annular flow path to advance a second component in said flow direction toward said post mix chamber from a second component source;

an axial path end plate blocking said axial flow path;

a premix aperture extending from said axial flow path to said annular flow path, proximate said axial path end plate;

a post mix aperture extending from said annular flow path to said post mix chamber, wherein, along said flow direction, said post mix aperture is positioned downstream of said premix aperture;

an annular premix chamber defined in said annular flow path between said premix aperture and said post mix aperture; and an annular flow path end plate blocking said annular flow path proximate said post mix aperture, wherein a first component advanced along said axial flow path toward said post mix chamber exits said axial flow path at said premix aperture and enters said annular premix chamber due to the blocking of the axial flow path by said axial path end plate, and a second component advanced along said annular flow path toward said post mix chamber mixes with said first component entering said annular premix chamber to form a premixture that exits said annular flow path at said post mix aperture and enters said post mix chamber due to the blocking of the axial flow path by said annular flow path end plate; and a mix media located downstream of the post mix aperture and proximate the post mix chamber;

wherein said axial path end plate, said annular flow path end plate, said post mix chamber, said post mix apertures, and said mix media are provided in a foam generator that is removable from the first and second component delivery tubes; and wherein said foam generator comprises a plurality of arms for connecting to the end surface of said first component delivery tube and wherein at least one premix chamber is formed between at least a portion of two or more arms.

16. The dispensing tube assembly of claim 15 wherein said plurality of arms include a radial step portion configured to space the axial end plate off of the end of the first component delivery tube.

17. The dispensing tube assembly of claim 16 wherein the plurality of arms further include a tapered outer surface configured to fit inside the second component delivery tube.

18. The dispensing tube assembly of claim 17 further comprising an axial extension, wherein the arms extend from the axial extension and the end of the second component delivery tube fits over the axial extension.

19. The dispensing tube assembly of claim 18 wherein the outside diameter of the foam generator is substantially the same as the outside diameter of the second component delivery tube.

* * * * *